United States Patent [19]

Hendrych

[11] Patent Number: 4,486,139

[45] Date of Patent: Dec. 4, 1984

[54] PUSHER RAM

[75] Inventor: Jiri Hendrych, Bethel Park, Pa.

[73] Assignee: Raymond Kaiser Engineers Inc., Oakland, Calif.

[21] Appl. No.: 412,028

[22] Filed: Aug. 26, 1982

[51] Int. Cl.[3] ..... C10B 33/10

[52] U.S. Cl. ..... 414/215

[58] Field of Search ..... 414/198, 215, 214, 586, 414/587; 202/262, 270; 432/235

[56] References Cited

U.S. PATENT DOCUMENTS 1,351,224 8/1920 Williams ..... 414/215

*Primary Examiner*—Robert G. Sheridan

*Attorney, Agent, or Firm*—Flehr, Hohbach, Test, Albritton & Herbert

[57] ABSTRACT

The invention comprises a plurality of improvements in pusher ram construction for use in coke ovens and the like. These improvements include: (1) two separate "heat spring" arrangements for absorbing both heat and mechanically induced stress in the web portion of a pusher ram, while maintaining desired rigidity; (2) five different constructions for relieving stress developed in welds in pusher ram beam members and/or welded connections between the web portion of a pusher ram and adjacent beam members; (3) two unique girder assembly arrangements to facilitate component replacement; (4) an improved girder web construction for accommodating decarbonizer piping or the like; (5) several useful advancements in ram head design and construction; (6) special heat shield applications for pusher rams; and (7) improvements in ram girder "bull nose" construction.

26 Claims, 38 Drawing Figures

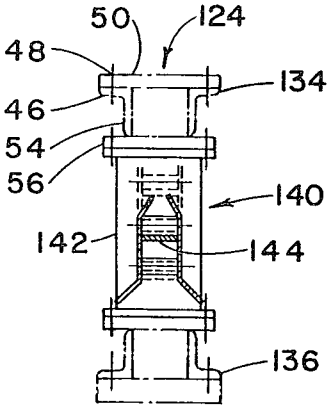
FIG. 4
FIG. 5
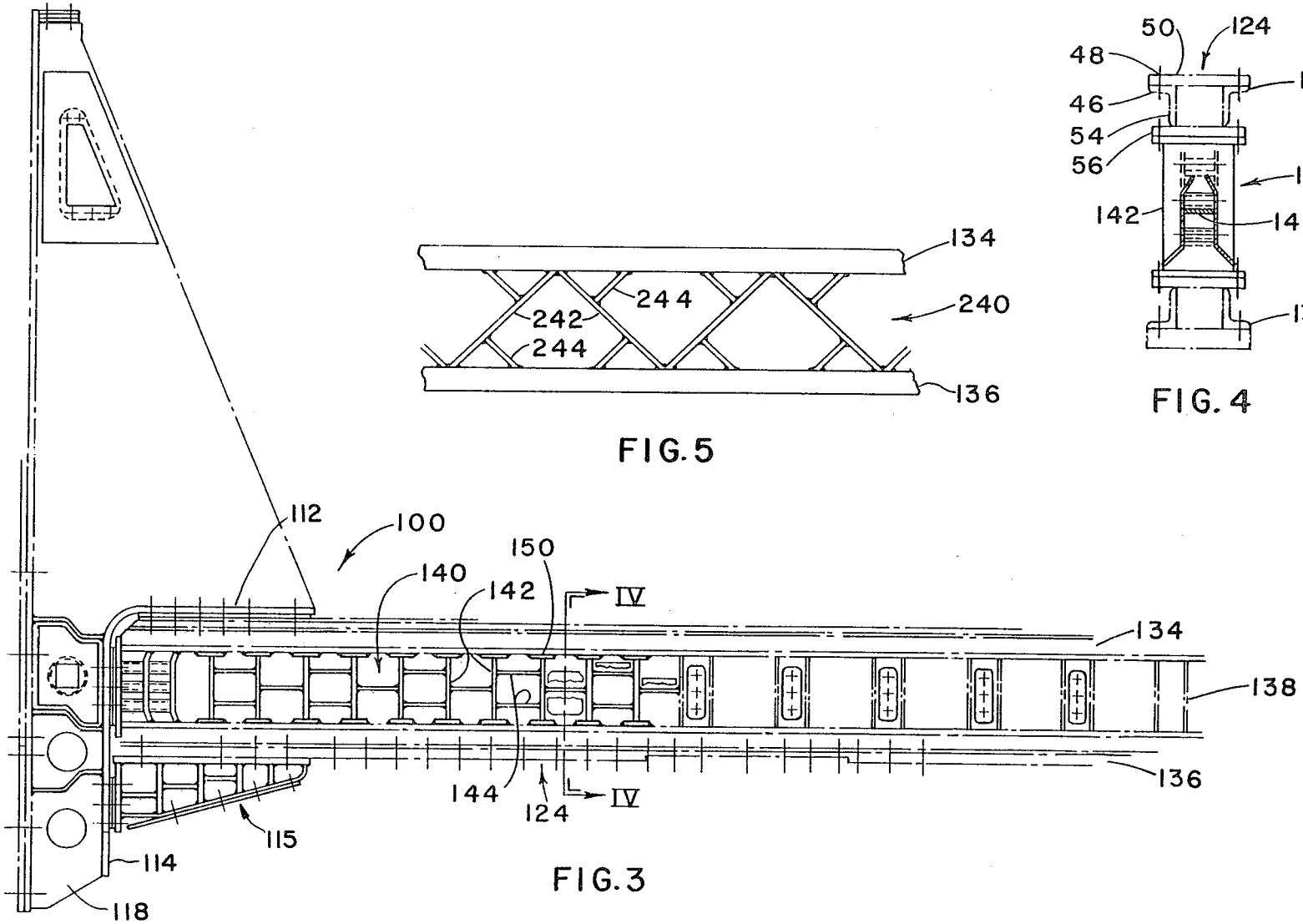
FIG. 3

PUSHER RAM

BACKGROUND OF THE INVENTION

1. Field of the Invention

Coke ovens and the like comprise the general field of invention; however, improvements in pusher ram construction for use in such ovens is the principal matter of interest herein.

Reference is made to the following related co-pending applications of which this application is a continuation, all filed on Aug. 26, 1984: Ser. No. 411,635 METHOD FOR CONSTRUCTING A PUSHER RAM; Ser. No. 411,636 METHOD FOR CONSTRUCTING A PUSHER RAM; Ser. No. 411,637, PUSHER RAM, now abandoned; Ser. No. 411,638 PUSHER RAM, now abandoned; Ser. No. 411,639 PUSHER RAM, now abandoned; Ser. No. 411,646 PUSHER RAM, now abandoned; Ser. No. 411,647 METHOD FOR CONSTRUCTING A PUSHER RAM; Ser. No. 411,648 METHOD FOR CONSTRUCTING A PUSHER RAM; Ser. No. 411,649 METHOD FOR CONSTRUCTING A PUSHER RAM; Ser. No. 411,951 PUSHER RAM, now abandoned; Ser. No. 411,952 PUSHER RAM, now abandoned; Ser. No. 411,961 PUSHER RAM, now abandoned; Ser. No. 411,962 PUSHER RAM, now abandoned; Ser. No. 411,963 PUSHER RAM, now abandoned; Ser. No. 411,964 PUSHER RAM, now abandoned; Ser. No. 411,965 PUSHER RAM.

2. Description of the Prior Art

Many pusher ram constructions for coke ovens have evolved over the years, particularly in the last few decades of increasing damand for coke for use in steelmaking. Although the general appearance and function of the many pusher rams developed over recent years has not changed too dramatically, one consideration that should always be uppermost in the set of parameters for any new pusher ram design is ram life. No matter how well a pusher ram is designed to do its job, its life span should always be such that it economically justifies the anticipated improvements from the new design. In particular, it should be apparent that achieving sufficient improvements in the day to day operational and functional performance of a new ram design, when also coupled with increased ram life, comprises the ultimate in improvements in coke oven pusher ram construction. It is these desiderata to which the present improvements are directed.

Typical examples of various prior art pusher ram designs may be found in U.S. Pat. Nos. 2,165,141; 3,272,356; 3,784,034; 3,912,091 and 4,253,915.

The particular prior art pusher ram construction to which the present improvements are directed is one that applicant's assignee has successfully manufactured and marketed in recent years. However, it will be apparent to those skilled in the art, from that which follows, that the developments disclosed herein may readily find general use in other and different ram constructions than that specifically forming the disclosed basis for the present improvements.

In the prior art pusher ram construction referred to above, upon critical analysis and after extensive experience in actual coke production, it has been found that a number of improvements related to accelerated fatigue and heat creep problems are possible that could extend the projected service life of the pusher ram by as much as 20 to 40%. In a typical ram installation where average pusher ram life to service half of a 79 oven battery has been determined to be in excess of five years, this could mean at least an extra two years of use. Moreover, maintenance time and materials, as well as maintenance costs, should be diminished over ram life. In addition, improved ram performance and ram life carries with it the additional benefits of maximizing oven usage and efficiency.

SUMMARY OF THE INVENTION

Accordingly, the desiderata herein are to improve the performance of pusher rams for coke ovens and to improve ram life. The improvements proposed include: (1) two separate "heat spring" arrangements for absorbing both heat and mechanically induced stress in the web portion of a pusher ram, while maintaining desired rigidity; (2) five different constructions for relieving stress developed in welds in pusher ram beam members and/or welded connections between the web portion of a pusher ram and adjacent beam members; (3) two unique girder assembly arrangements to facilitate component replacement; (4) an improved girder web construction for accommodating decarbonizer piping or the like; (5) several useful advancements in ram head design and construction; (6) special heat shield applications for pusher rams; and (7) improvements in ram girder "bull nose" construction.

BRIEF DESCRIPTION OF THE DRAWINGS

FIG. 3 is an elevation view, partly in phantom, illustrating some improved features disclosed herein, particularly one embodiment of a "heat insert" or "heat spring."

FIG. 4 is a section along the line IV—IV of FIG. 3.

FIG. 5 is a schematic elevation view of an alternative "heat insert" arrangement employing concepts of the "heat insert" of FIGS. 3 and 4.

DESCRIPTION OF THE PREFERRED EMBODIMENTS

Figure 1A:
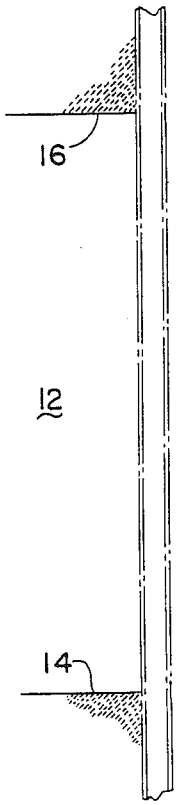
FIG. 1A PRIOR ART
FIG. 1 taken together with FIG. 1A is an elevation view of a prior art coke oven pusher ram shown in position for entry into a coke oven.
Figure 1:
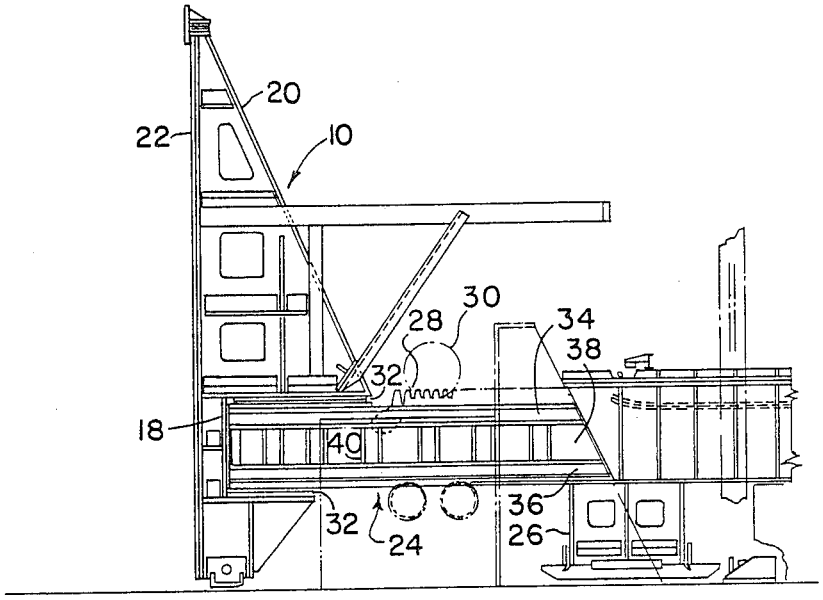
FIG. 1 PRIOR ART

Shown in FIG. 1 is a view of a prior art pusher ram construction 10 with which the present improvements are concerned. Pusher ram 10 is shown in position for entry into a coke oven 12, of conventional construction, having a floor 14, a roof 16 and side walls (not shown), and in which coal is carbonized into coke by well known processing techniques, such as disclosed in "The Making, Shaping And Treating Of Steel," published by United States Steel Corporation, Ninth Edition, 1971. Typically, an individual coke oven, which may be one of a battery of such ovens, can have interior coking chamber dimensions of the order of 20 feet high, 1.5 feet wide and 50 feet long. It is into such a chamber that, after coking, an elongated pusher ram is inserted and driven forward from the pusher side of the oven through the entire extremity of the coke oven to push the coke into an awaiting quench car at the opposite or coke side of the oven.

Basically, the pusher ram shown comprises a ram head 20 having a front or coke engaging face 22, of planar dimensions only slightly smaller than the corresponding width and height dimensions of the coking chamber of the oven 12, an elongated ram girder 24 of longitudinal extent sufficient to pass the face of the ram head completely through the oven, a ram shoe 26 depending downwardly from the ram girder aft of the ram head and a ram drive which, as shown, may include a rack 28 and a driving pinion 30. All of the foregoing is generally mounted on and forms an integral part of a conventional pusher machine that is suitably mounted on tracks or the like and traverses a coke battery, from oven to oven, to push the coke at the completion of each coking cycle.

Figure 2D:
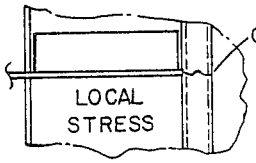
FIG. 2D PRIOR ART
FIG. 2 taken together with FIGS. 2A-2H is a pictorial view of the pusher ram of FIG. 1 illustrating in related exploded views FIGS. 2A-2H some of the major problems encountered over the life of such a pusher ram.
Figure 2C:
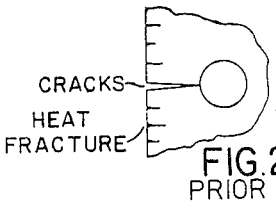
FIG. 2C PRIOR ART
Figure 2E:
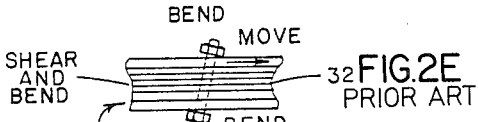
FIG. 2E PRIOR ART
Figure 2F:
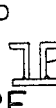
FIG. 2F PRIOR ART
Figure 2G:
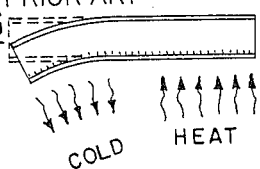
FIG. 2G PRIOR ART
Figure 2B:
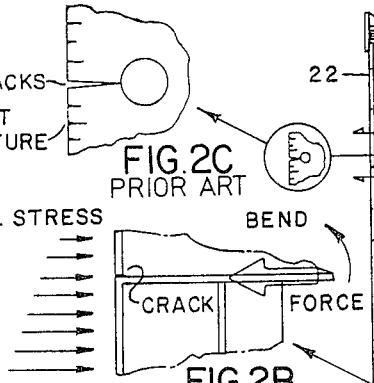
FIG. 2B PRIOR ART
Figure 2A:
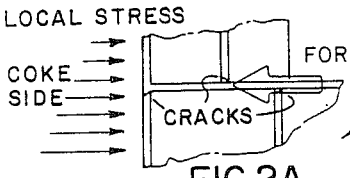
FIG. 2A PRIOR ART
Figure 2:
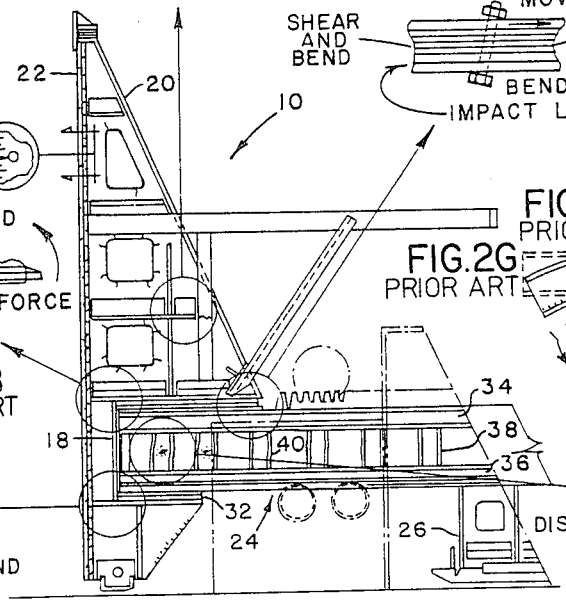
FIG. 2 PRIOR ART
Figure 2H:
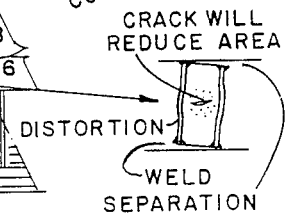
FIG. 2H PRIOR ART

More specifically, reference is now made to FIG. 2 where there is illustrated some of the major structural problems encountered in the operation of such pusher rams that significantly diminish ram life and increase ram maintenance. Shown clockwise, in the first four of the enlarged exploded views, are stress cracks and heat fractures induced in the ram head and ram face during normal operation of the prior art pusher ram construction of FIGS. 1 and 2. Illustrated in the fifth view or position is observed shear and bending that occurs at both upper and lower ram head to ram girder interfaces where U-flange type bolted mounting 18 of the ram head to the ram girder is employed, along with interposed shims 32 for purposes of ram head vertical adjustment.

In the next position, moving clockwise, is illustrated ram beam deflection that is experienced during normal heat cycling occurring in use. In the embodiment shown, the ram girder 24 is comprised of upper and lower such beams, 34 and 36, respectively, and an intermediate interconnecting web 38 of spaced wide flange beams 40 welded thereto. Further details of improvements in the structure of beams 34 and 36 will follow, but for the moment, as shown in cross-section, these beams are generally comprised of spaced angle members 52 arranged back to back and having a vertical rib or flange 54 endwelded to an elongated inner plate or flat 56 and a horizontal rib or flange 46 joined by means of bolts 48 to a second or outer elongated plate or flat 50 that is disposed in opposed, spaced relation to inner plate 56. Plate 56, in turn, is welded to the wide flange beam 40. In the final position is shown the further problems of flange distortion, web cracks and weld separation that occurs in the wide flange web members 40, which are actually lengths of standard 8 WF40 wide flange beam material.

Turning now to FIGS. 3 and 4, we proceed to explore some of the improvements developed for pusher ram constructions fraught with some or all of the problems briefly enumerated in connection with the pusher ram construction of FIGS. 1 and 2. Attention is specifically directed, at the outset, to the so-called "heat spring" or "heat insert" 140 comprising the major longitudinal portion of the web component 138 at the front or forward end of the pusher ram 100.

Heat insert 140 essentially comprises a horizontal or longitudinal series of spaced structural plates 142 that are located 9 to 18 inches, preferably 12 to 15 inches, on centers, and which are integrated with, as by welding, and extend between upper beam member 134 and lower beam member 136 of ram girder 124. These structural plates 142, which in the embodiment shown typically comprise steel plates that measure 9 to 12 inches wide by 16 to 18 inches high by 1 to 1¼ inches thick, are arranged with their major surfaces facing longitudinally and extending transversely of the ram girder 124. Also included are brace-like or strut-like bending control means 144, carried on the structural plates 142 at at least one intermediate location between the upper and lower beam members 134 and 136, respectively, so as to locally constrain transverse bending movement of the structural plates at such intermediate location when the structural plates are heated in the oven during use and subsequently cooled after removal therefrom. Bending control means 144 may typically comprise steel plates or bars that measure 4 to 6 inches wide by 12 to 15 inches long by ¾ inches thick.

In the particular embodiment shown in FIGS. 3 and 4, heat insert plates 142 are arranged vertically, with horizontally disposed bending control means 144 being interposed and tee joint welded therebetween in an offset manner, as shown, between successive pairs of vertical plates 142. Thus, there is established a grid or lattice of web plates in which longitudinally successive horizontal brace members 144 are arranged in offset step-like fashion so that each can expand and contract without being directly opposed by another, to provide the insert 140 with a high degree of longitudinal flexibility. Moreover, as will be understood, the vertical members or plates 142 of web insert 140 may independently expand and contract in a vertical direction, thus accommodating or providing a relatively high degree of vertical flexibility. Thus, in view of such flexibility in the web insert 140 and the obvious spring-like characteristics it imparts, it has been termed a "heat spring." Also, it should be pointed out that the relatively narrow profile of its constituent members, relative to radiant heat emanating from the oven side walls, diminishes substantially its functioning as a substantial radiant-heat-receiving heat sink. The manner of integrating or attaching web insert 140 to upper beam member 134 and lower beam member 136, in the embodiment shown, is by means of "tack plates" 150, the use and function of which will be explained more fully hereinafter.

With reference to FIG. 5, there is shown an alterative preferred heat spring or heat insert 240 that may be employed and that functions on the same principles in substantially the same manner as web or heat insert 140. In this embodiment, vertical support or interconnection between beam members 134 and 136 and, indeed, the previously described vertical flexibility of heat insert 140, is provided by the continuous longitudinal array of angularly disposed structural plates 242 welded thereto. Moreover, bending control for such plates 242, as well as a vector component of horizontal movement (flexibility) for insert 240 is provided by laterally offset struts, bars or plates 244 that are of opposite angular disposition to that of the angular plates 242 and have opposite longitudinal ends, as shown, tee welded to plates 242 and angle welded to beams 134 or 136. Of course, for a given structure such as shown in FIGS. 3 and 4, the dimensions of the insert members shown in FIG. 5 would be generally proportional to those of the prior drawing figures.

Figure 6:
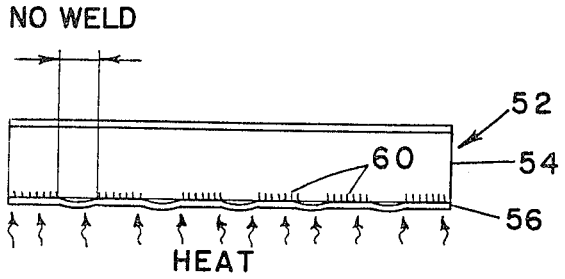
FIG. 6 is a schematic illustration of the "skip weld" or discontinuous weld improvement proposed for ram girder construction.
Figure 7:
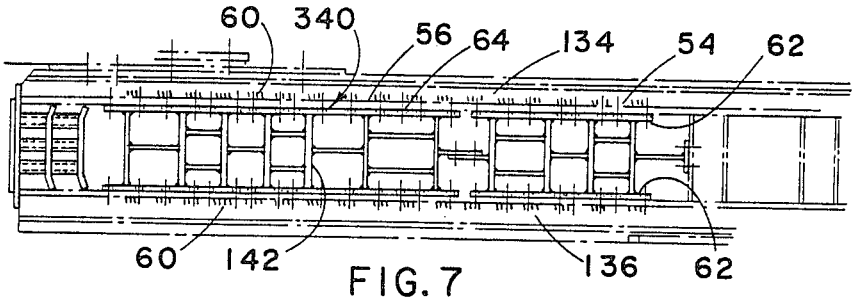
FIG. 7 is an elevation of portions of the front end of an improved ram girder illustrating the advantageous use of the combination of discontinuous welds and bolted construction.

Moving to FIG. 6, we begin to develop another aspect of improvements in pusher ram design and construction. More specifically, FIGS. 6 through 11 are directly concerned with means for relieving stress developed in welds in pusher ram beam members and/or welded connections between the web portion of a pusher ram and adjacent beam members. FIGS. 6, 7 and 10 specifically relate to so-called "skip" or discontinuous welding, while FIGS. 8 and 9 relate specifically to continuous welding and FIG. 11 may relate to both types of welding, even though the improvement of FIG. 11 was developed primarily for situations involving continuous welding.

Figure 8:
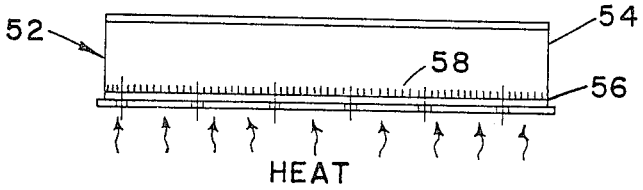
FIG. 8 is a schematic illustration of the improved use, in combination, of continuous welds and bolted construction for ram girders.

Taking FIGS. 6 and 8 together while keeping in mind a preferred general construction (see FIG. 4) of upper and lower beam members 34 and 36, respectively, the prior art beam construction included an elongated angle member 52 having a rib or flange 54 continuously edge welded, as at 58 (FIG. 8), to an elongated structural plate or flat 56. Such a construction, when exposed to normal heat cycling (FIG. 2, sixth position) over a period of time, was found to develop permanent deformation due to heat stress, causing the ram girder to assume a longitudinal waviness, frequently additionally characterized by an uptruned front end. This prior waviness and upturned front end has been corrected or substantially eliminated by virtue of sizing the elongated, horizontal plate component 56 such that its thickness along its length is not significantly greater than and is preferably less than the thickness of the elongated structural flange or rib 54 and joining the elongated structural rib of the beam members to the elongated structural plate component by means of a series of relatively short, e.g. 3 to 6 inches, substantially regularly spaced, e.g., 2 to 4 times weld length, tee weld joints 60. As illustrated schematically in FIG. 6, such a construction permits the material of plate 56 to freely expand and contract between adjacent weld joints 60 such that sufficient stress does not develop in the weld material to cause permanent deformation.

With reference ot FIG. 7, the "skip weld" beam construction described in connection with FIG. 6 is shown being used in combination with a bolted-on heat insert or web insert 340 constructed in accordance with the heat insert principles hereinabove disclosed. Web insert 340, as contrasted to web insert 140, has the opposite ends of its vertical members 142 tee joint welded to upper and lower plates 62 which, in turn, are bolted through slotted apertures 64 to plates 56 of upper and lower beam members 134 and 136 as shown. Plates 56 of upper and lower beam members 134 and 136, in this embodiment, are joined to their respective ribs or flanges 54 by means of "skip" or discontinuous welds 60. Thus, limited expansion and contraction of plates 56 is permitted between "skip" welds 60, as well as limited sliding movement of plates 62 by reason of slotted apertures 64, all of which is in addition to the previously described flexibility provided by "heat insert" 340.

Figure 9:
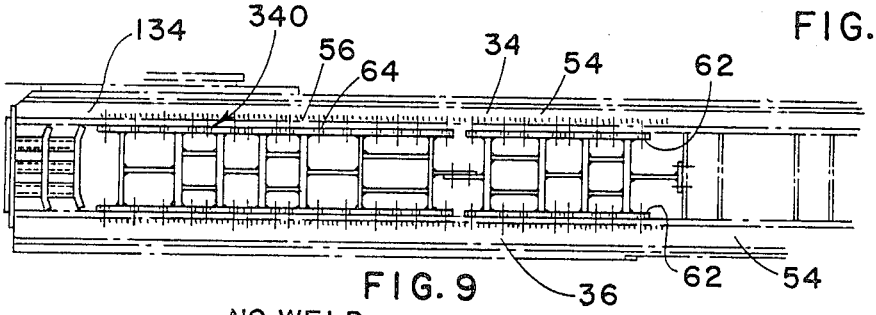
FIG. 9 is an elevation similar to FIG. 7 illustrating use of the combination of continuous welds and bolted construction in an improved ram girder.
Figures 10, 10A:
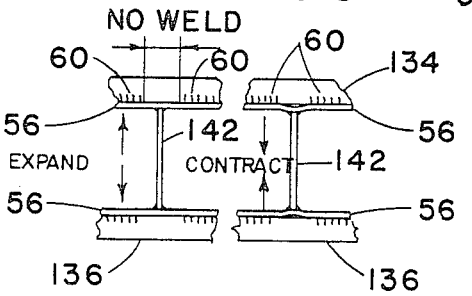
FIGS. 10 and 10A are schematic elevations of a portion of an improved ram girder illustrating the proper positioning of vertical "heat insert" members with respect to beams employing discontinuous welds and the effect of heat changes thereon.

With particular reference to FIGS. 8 and 9, shown is a ram girder construction substantially identical to that of FIGS. 6 and 7 except for the use of a continuous weld 58 to join ribs or flanges 54 to plates 56. Accordingly, the limited expansion and contraction of plates 56 between the "skip" welds 60 of the previous embodiment is precluded while all else remains the same.

Turning now to FIGS. 10 and 10A, shown is the proper mode of positioning vertical heat insert members 142 with respect to upper and lower beams 134 and 136 that employ discontinuous welds 60, and the effect of heat changes thereon in those situations where it is desirable to weld the heat insert directly to the girder beams rather than to bolted-on plates, as shown in FIGS. 6 to 9. As will be apparent to those skilled in the art, tee joint welding of vertical members 142 to plates 56 of upper and lower beam members 134 and 136 at the location of the space or skip between welds 60, not only takes advantage of the freedom of the joined material to move between adjacent welds but, in fact, encourages such movement. More specifically, as illustrated, this "skip" material can follow the expansion and contraction of the vertical members 142, thus relieving or substantially relieving pressure and stress buildup in the joined members and their welded interconnection.

Figure 11:
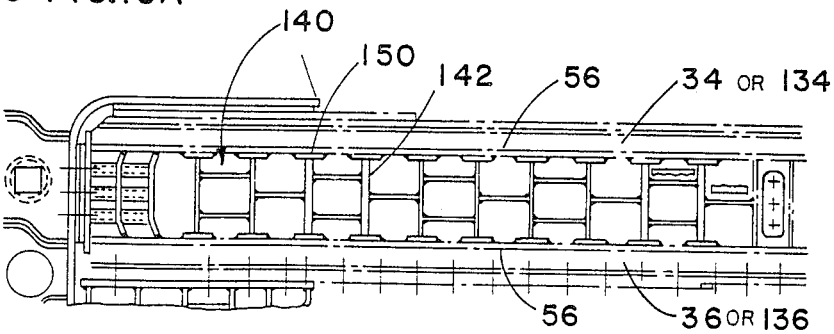
FIG. 11 is an elevation of part of the front end of an improved ram girder showing yet another mode of relieving stress in a ram girder by use of "tack plates" to join a "heat insert" construction to adjacent beam members.

As a final illustrated facet of this aspect of improvements in ram girder construction, there is shown in FIG. 11 the heat insert construction of FIGS. 3 and 4 wherein "tack plates" are employed, in lieu of or in addition to "skip welding" of the upper and lower beams, to join heat insert 140 to beam members 34 and 36 or 134 and 136. The "tack plates" 150 are secured, as by welding, in T-fashion to the opposite ends of vertical insert plates 142 and thence are welded along opposite transverse edges in lap joint fashion to the elongated horizontal plates 56 of the upper and lower beam members. Typically, such a "tack plate" may measure about 4 to 6 inches wide by 9 to 12 inches long by 1 to 1¼ inches thick. With this arrangement, the material between the lap joints of each tack plate 150 can move in response to expansion and contraction of the vertical insert plates 142, in a manner similar to the permitted movement of the material of plates 56 between skip welds 60 as described above. Thus, stress and pressure buildup in and at the junction of these members can be alleviated.

Figure 12:
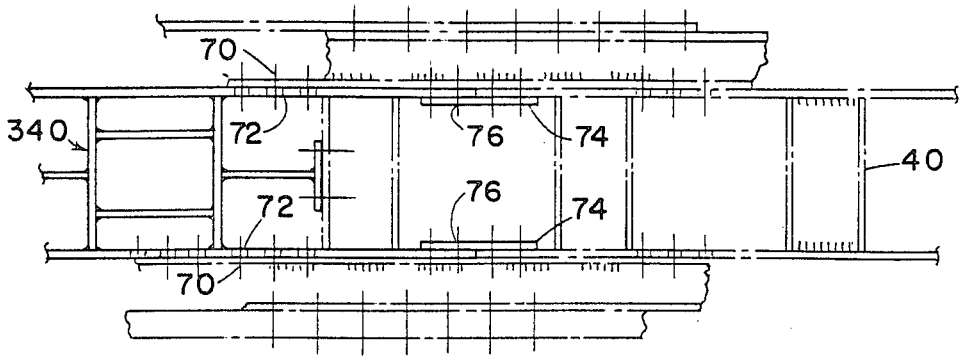
FIG. 12 is a schematic elevation of part of a ram girder illustrating both ram girder improvements through bolted web to beam construction and splice girder construction.

With reference to FIG. 12, an additional feature proposed for improved ram girder construction is to construct the girder such that its upper beam member, its lower beam member and its web member, or known portions thereof that are susceptible to premature failure, are held in assembled or juxtaposed relation by means of bolted interconnections 70 though one or more slotted apertures or the like 72. This construction applies whether such web members comprise the disclosed heat insert construction, the disclosed prior art wide flange construction, both of the aforesaid web constructions in combination and/or other or different web constructions. While it is known that, in other and different environments, bolted interconnections of components to facilitate removal and replacement of a defective one of such components is used, it is unique in the present environment. Also, there is achieved, in connection with the disclosed ram girder constructions, the further unique effect of permitting limited slidng movement between such components, under stress of heat cycling, thus enhancing ram flexibility and/or precluding ram girder distortion due to buildup of undesirable localized stresses characteristic of rigid attachment, such as by welding.

A further improved construction feature illustrated in FIG. 12, with or without the above described feature, is the implementation of girder splicing by means of bolted splice plates 74. In this connection, use of slotted apertures to permit movement is generally not desirable and rigid bolted connections 76 are employed. In accordance with this aspect of the present disclosure, not only can a discrete longitudinal section of ram girder be removed and replaced, but also custom ram girders, to accommodate special operating conditions, can be assembled from a variety of premanufactured lengths of different ram girder construction.

Figure 13:
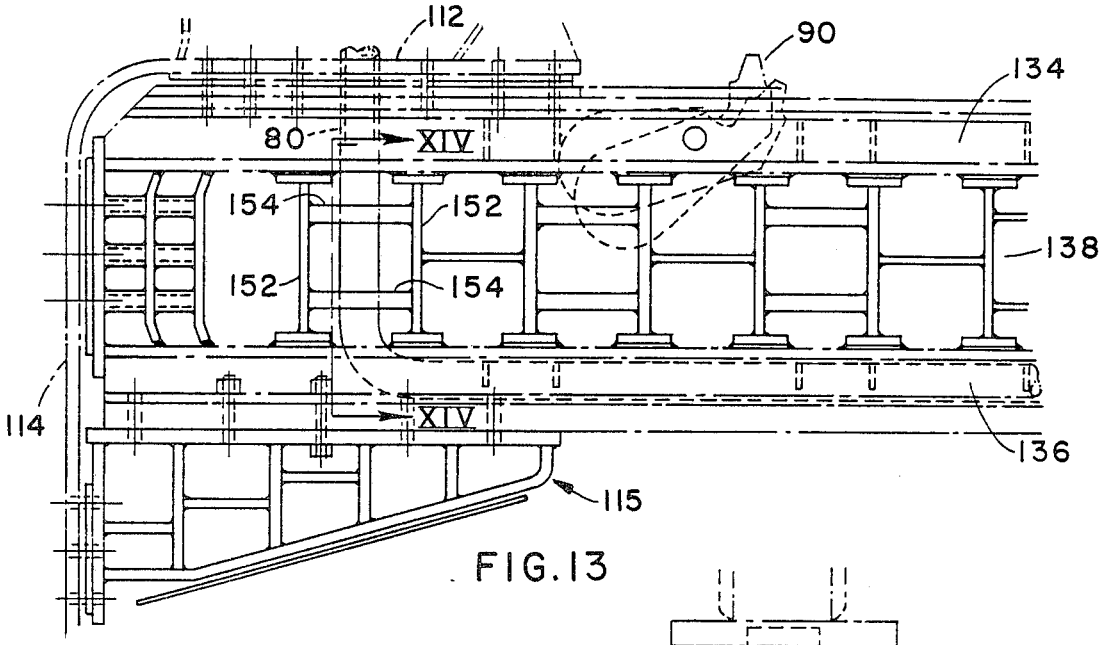
FIG. 13 is a view in elevation of portions of the front end of a ram girder illustrating a decarbonizer pipe support improvement.
Figure 14:
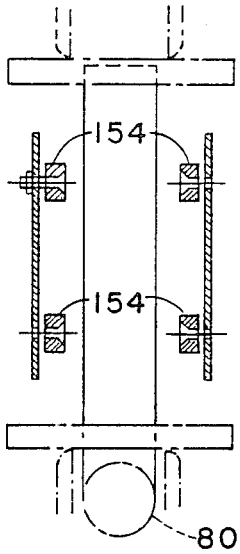
FIG. 14 is a section along the line XIV—XIV of FIG. 13.

In FIGS. 13 and 14 is shown a special adaptation of the disclosed heat insert construction of FIGS. 3 and 4, for use in accommodating decarbonizer piping 80 or other such ram girder components as loose tooth 90 of rack 28. Specifically, as shown, in such areas or zones where clearance is required through or within web 138 permitting passage or clearance for such components the web comprises a vertical structural plate 152 forward and rearward of such zone that extends between the upper and lower beam members 134 and 136, and which are arranged with their major surfaces facing longitudinally and extending transversely of the ram girder, and horizontal braces or struts 154 flanking such component, such as the decarbonizer pipe 80, and interconnecting the vertical plates 152. Typically, plates 152 may be on the order of 9 to 12 inches wide by 16 to 18 inches high and of 1¼ inch plate material, while brace 154 may be about 2 inches wide by 12 to 15 inches long and of 1 inch thick plate material.

Figure 15:
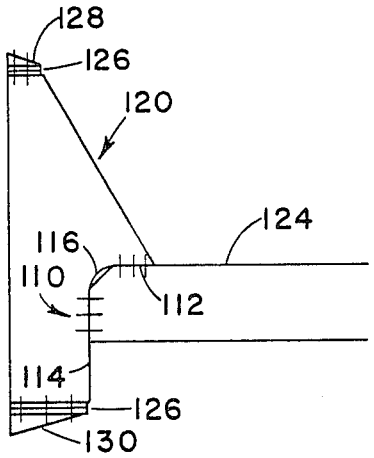
FIG. 15 is a schematic view, in elevation, of the front end of a pusher ram illustrating an improved construction for vertical ram head adjustment as well as an improved radius-type ram head to ram girder mounting arrangement.

FIG. 15 shows important improvements in ram head construction that eliminates at least two major problems inherent in the prior art pusher ram construction of FIGS. 1 and 2. First, is the elimination of shims 32 (FIG. 2) for purposes of ram head vertical adjustment and, second, is the elimination of the U-flange type bolted mounting 18 (FIG. 2) of the ram head 20 to the ram girder 24.

Figure 17:
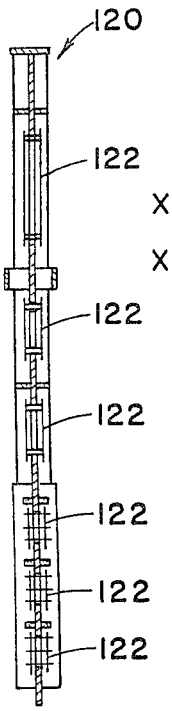
FIG. 17 is a section along the line XVII—XVII of FIG. 16.
Figure 16:
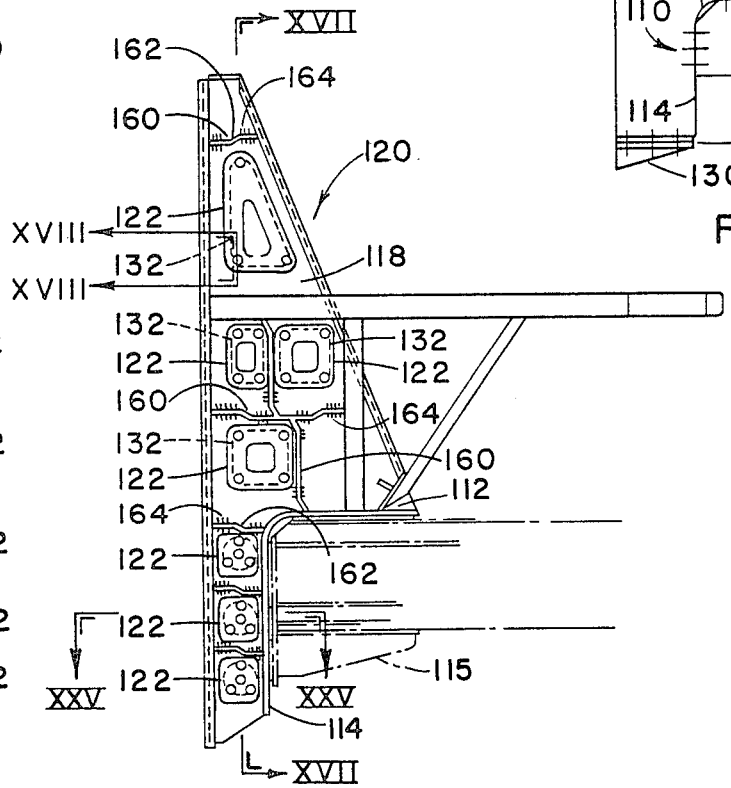
FIG. 16 is an elevation of an improved ram head showing heat shield and web stiffener improvements therefor, as well as its improved radius-type mounting construction.

In the improved embodiment of FIGS. 15–17, the ram head 120 has an inverted generally L-shaped rear surface portion 110 constructed and arranged so that the horizontal leg 112 of the inverted L-shaped portion overlies adjacent horizontal portions of the ram girder 124 and the vertical leg 114 faces the adjacent end of the girder and extends to near the oven floor (not shown). More particularly, the horizontal leg 112 merges through an intermediate radiused portion 116 into the vertical leg 114 to eliminate or substantially reduce the development of stress concentration, in use, in this critical horizontal to vertical transition zone. Further, the ram head 120 is affixed, as by bolting, to the ram girder 124, free of undesirable shims between the girder and the horizontal leg portion 112 of the ram head. In lieu of such shims for the purpose of vertical adjustment of the ram head, a replacable ram head piece or tip is affixed to at least one of the top and bottom extremities of the ram head with sufficient interposed shims 126 to obtain the desired vertical adjustment or clearance between the composite ram head and the oven roof and/or floor. As shown, both a top piece 128 and a bottom piece 130 may be used for adjustment purposes. Alternatively, it may be desirable to use only a top such adjustment piece with suitable provision being made in the manufactured length of vertical leg 114, such that the vertical leg can be cut in the field to provide desired clearance between that leg and the oven floor.

As shown in FIGS. 13 and 16 the horizontal and vertical portions 112 and 114 are shown integral and connected by an arcuate portion. Both portions 112 and 114 are secured over substantially their entire length to the web 118 of the ram head structure. The portion 114 extends below the girder and provides means for mounting the structure 115 which underlies the adjacent end of the beam.

In FIGS. 16 to 25, attention is directed to the beneficial use of heat shields or the like in improved pusher ram construction. FIGS. 15 to 18 also deal with an improved construction for stiffeners, primarily for use on the web portion of a ram head.

Figure 18:
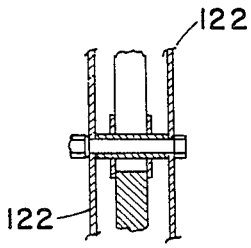
FIG. 18 is a section along the line XVIII—XVIII of FIG. 16.

Shown in FIGS. 16 to 18 are heat or radiation shields for use on the web portion 118 of ram head 120. As will be understood throughout that which follow, the primary function of a heat shield is to prevent premature heat degredation of shielded ram material by literally shielding such ram material from being in direct "line of view" of the radiant heat eminating from the oven walls.

In FIGS. 16 to 18 there is shown a plurality of areas in the web portion 118 of ram head 120 that are cut-out or open, firstly, for the purpose of air circulation across or through the web 118 and, secondly, for reducing the weight of the ram head 120. In such circumstances, there is provided ring-like heat shield members or plates 122 affixed to the web 118 and flanking the cut-out portions 132 in spaced, parallel relation thereto and having exterior peripheral dimensions similar to but greater than the dimensions of the respective cut-out portions and interior peripheral dimensions similar to but less than the cut-out dimensions. Preferably, heat shield members 122 are of 3/16 inch stainless steel plate.

Also shown in FIGS. 16 through 18 are improved head flange or web stiffeners 160 for ram head 120. In this improved construction, the web stiffeners 160 are affixed to the sides of the web 118 and are comprised of elongated bar-like members having a minor longitudinal portion 162 thereof offset with respect to the remainder of the bar-like member. The bar-like member is welded, as at 164, to the web on either side of the minor longitudinal portion 162 and the minor longitudinal portion 162 is free of attachment to the web of the ram head. In this fashion the unwelded or free portion or portions 162 of the stiffeners 160 permits stress release for the remainder of the stiffener, thus avoiding stress cracks from occurring.

Figure 19:
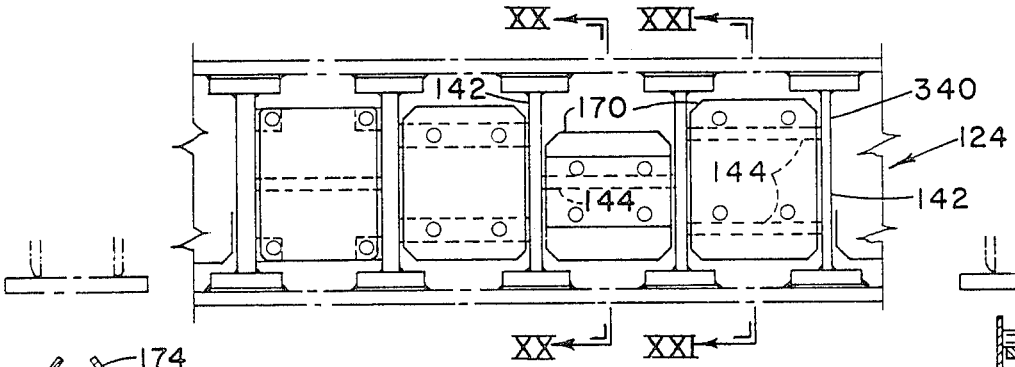
FIG. 19 is an elevation of a "heat insert" portion of an improved ram girder showing radiation plates or heat shields in a typical installation.
Figure 20:
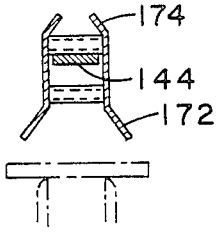
FIG. 20 is a section along the line XX—XX of FIG. 19.
Figure 21:
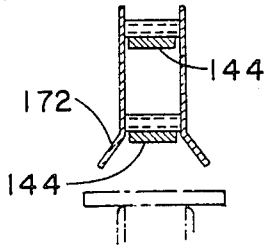
FIG. 21 is a section along the line XXI—XXI of FIG. 19.
Figure 22:
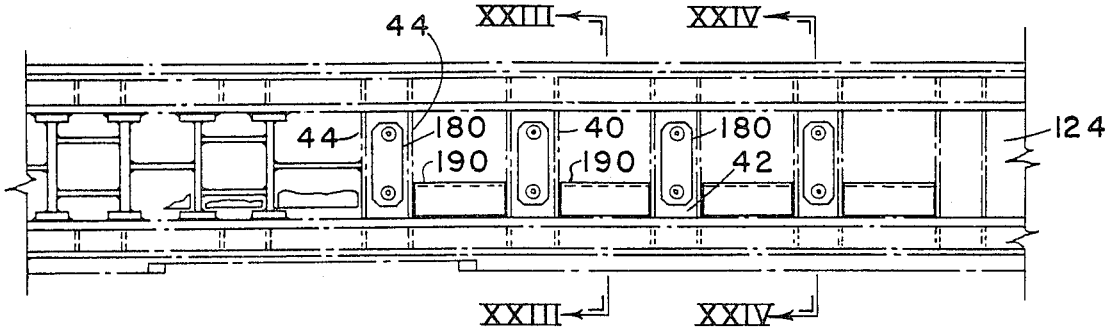
FIG. 22 is an elevation of a wide flange portion of an improved ram girder showing radiation plates or heat shields in a typical installation.
Figure 23:
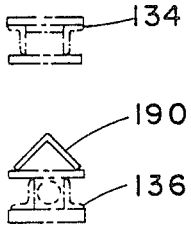
FIG. 23 is a section along the line XXIII—XXIII of FIG. 22.
Figure 24:
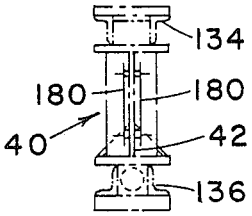
FIG. 24 is a section along the line XXIV—XXIV of FIG. 22.

With reference to FIGS. 19 through 24 there are shown girder heat shields, also preferably of 3/16 inch stainless steel plate, for both the improved "heat insert" web construction for ram girders and prior art wide flange web construction. In FIGS. 19 to 21, for use in connection with the "heat insert" web construction, there are shown plate-like heat shield members 170 affixed parallel to the sides of the girder 124 and flanking the brace plates 144 of the "heat insert" 340 in spaced relation thereto. As thus arranged, the heat shield members 179 shade the brace plates 144 and a major portion of the vertical plates 142 of the "heat insert" 340 from radiant heat eminating from the oven walls. It will also be understood that identical construction may be used with "heat insert" 140 and that similar construction, using triangular heat shields, may be employed in connection with the alternate "heat insert" construction 240 of FIG. 5. Additionally, as shown, heat shield members 170 may be provided with outwardly flaring particle deflection "skirt" portions 172 and/or inwardly flaring particle deflection "shoulder" portions 174 to provide protection against coke particles accumulating on the interior of the ram girder.

In FIGS. 21 to 25, for use in connection with the prior art wide flange web construction, there are shown plate-like heat shield members 180 affixed parallel and in spaced relation to the sides of the girder 124 and flanking the web portion 42 of the wide flange member 40 comprising the girder web. Moreover, in the open spaces between the wide flange members 40, there are shown downwardly open, angle shaped or "tent" shaped particle deflection shields 190, preferably of 3/16 inch plate, extending across and shielding these intermediate portions of the lower beam member 136 of the ram girder from coke particle accumulation. As thus arranged, the heat shield members 180 shade the web portion 42 of the wide flange members, as well as portions of their flanges 44 from radiant heat from the oven. Also, the "tent" shaped particle shields 190 protect adjacent portions of the lower beam member 136 from particle accumulation thereon. Moreover, as aforesaid, it will be understood that heat shield members 180 may be provided with outwardly flaring "skirt" portions and/or inwardly flaring "shoulder" portions to provide protection against particle accumulation on the adjacent interior portions of the ram girder.

Figure 25:
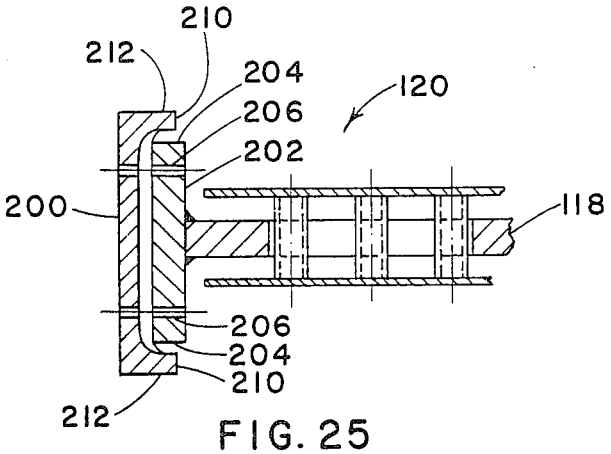
FIG. 25 is a schematic, in horizontal section, of the face plate area of a ram head showing an improved face plate design having rearwardly extending flanges to provide radiant heat protection.
Figure 27:
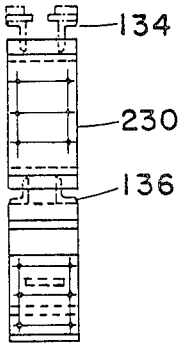
FIG. 27 is a section along the line XXVII—XXVII of FIG. 26.
Figure 26:
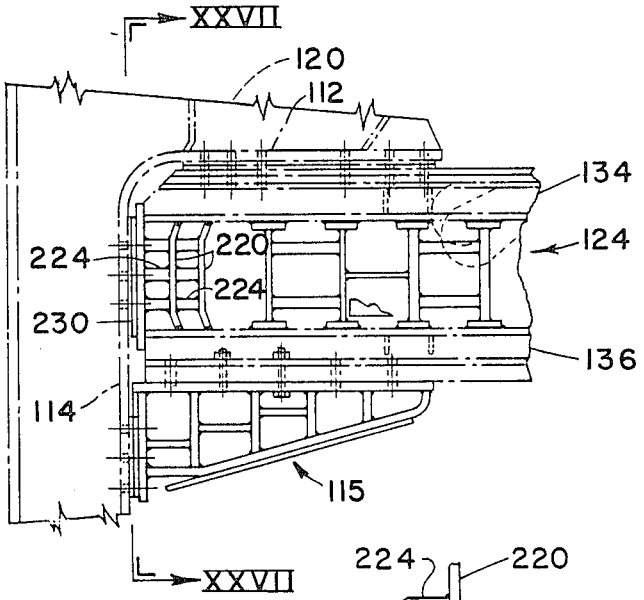
FIG. 26 is an elevation of the front or forward end portion of a ram girder showing an improved "bull nose" construction.
Figure 28:
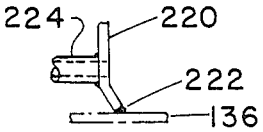
FIG. 28 is an enlarged detail of the weld joint of the bent plate "bull nose" construction of FIG. 26.

With reference now to FIG. 25, there is shown a further heat shield construction specifically designed to provide heat radiation protection for ram face plate support portions and adjacent web portions of the ram head. In particular, in the construction shown, a replaceable ram face plate 200, that substantially spans the width and height of the oven, is affixed, as by bolting, to a plate 202 forming the front of the ram head. In order to protect against heat fracturing of the side edges 204 of plate 202 and the development of cracks extending from the plate's bolt holes 206 to the side edges 204 (FIG. 2), as well as to some extent to protect the web 118 of the ram head 120, there is provided rearwardly extending flanges 210 carried on the vertically disposed side edges 212 of the ram face plate 200 to shade the adjacent portions of the ram head from radiant heat emanating from the pushed coke and the oven side walls. Transverse ribs **200*a* on the inner face of plate 200 retain the plate 200 and body plate 202** in spaced relationship.

In the final figures of drawing, 26 through 28, there is shown an improved ram girder "bull nose" construction in which the front end of the ram girder 124, adjacent the ram head 120, is comprised of a plurality of parallel arranged, spaced apart plate members 220 extending transversely of the girder. Each plate member 220 is bent along its upper and lower edges, as shown, and is effectively tee welded, as at 222, along the edges of the bent ends to the upper and lower beam members 134 and 136, respectively. Interplate bracing 224, such as pipe bracing, extends between the spaced apart plate members 220, tying the plate members together and, further, such pipe bracing is also shown extening from the frontmost bent plate to the front or forward end 230 of the ram girder. In this manner there is provided an extremely strong and stable, though somewhat resilient ram girder "bull nose" construction.

Although the present improvements have been shown and described in connection with particular embodiments thereof, it will be understood that they may otherwise be embodied within the scope of the following claims.

What is claimed:

1. A pusher ram for coke ovens and the like comprising, an upstanding ram head having a ram face substantially spanning the width and height of said oven, a horizontal ram girder affixed to the rear of said ram head and comprised of an elongated upper longitudinal beam member, an elongated lower longitudinal beam member and web means integrating said upper and lower beam members into a structural ram girder, said ram head having an inverted L-shaped rear surface portion constructed and arranged so that the horizontal leg of said inverted L-shaped portion overlies adjacent horizontal portions of said girder and the vertical leg of said inverted L-shaped portion faces the adjacent end of said girder and extends to near the oven floor, said ram head being affixed to said girder free of shims between said girder and said horizontal leg portion of said ram head and, a replaceable ram head piece affixed to one of the upper and lower extremities of said ram head with sufficient interposed shims to obtain desired vertical clearance between said ram head piece and the oven chamber.

2. A pusher ram as in claim 1 in which said replaceable ram head piece is affixed to the upper extremity of said ram head.

3. A pusher ram as in claim 1 in which said replaceable ram head piece is affixed to the lower extremity of said ram head.

4. A pusher ram as in claim 1 in which a said replaceable ram head piece is affixed to both the upper and lower extremities of said ram head.

5. A pusher ram as in claim 2 in which said replaceable ram head piece is affixed by bolts.

6. A pusher ram as in claim 3 in which said replaceable ram head piece is affixed by bolts.

7. A pusher ram as in claim 4 in which both said replaceable ram head pieces are affixed by bolts.

8. A pusher ram structure for coke ovens comprising:

a horizontal pusher girder;

a ram head structure secured to one end of the girder, the ram head structure having a vertical ram face dimensioned to substantially span the width and height of said oven;

the head structure including integral plate-like structural members disposed as viewed in side elevation to conform to an inverted L to provide upper horizontal and vertical depending portions;

one end of the ram girder being disposed with its upper surface adjacent to and secured to the horizontal portion and having its end face adjacent to and secured to the depending portion;

the depending portion extending a substantial distance below the lower surface of the girder;

the head structure including a plate-like web extending substantially the height of the ram face, the web being dimensioned to embrace the said horizontal and vertical portions and being secured thereto;

and means secured to the extension of the depending portion serving to engage the lower side of said end of the girder.

9. A pusher ram head for coke ovens and the like wherein said ram head is affixed to a generally rectangular end portion of an elongated generally horizontally disposed pusher ram girder, said ram head comprising:

a generally upstanding ram head structure having a ram face substantially spanning the width and height of said oven;

said ram head structure comprising a substantially continuous plate-like planar web interconnecting its front and rear portions;

said planar web having cut-out openings therein to reduce weight and heat absorption; and ring-like heat shield members affixed to said web and flanking said cut-out portions in spaced, parallel relation thereto and having exterior peripheral dimensions similar to but greater than those of the respective cut-out portions and interior peripheral dimensions similar to but less than the cut-out dimensions.

10. A pusher ram head as in claim 9 in which said ring-like heat shield members are comprised of stainless steel plates.

11. A pusher ram head as in claim 9 in which said ram head body member has a substantially continuous plate-like planar web interconnecting its front and rear portions;

web stiffeners affixed to the sides of said web comprised of elongated bar-like members having a minor longitudinal portion thereof offset with respect to the remainder of said bar-like member;

said bar-like member being welded to said web on either side of said minor longitudinal portion; and said minor longitudinal portion being free of attachment of said web.

12. A pusher ram head structure for coke ovens comprising:

a substantially cntinuous plate-like planar web interconnecting the front and rear portions of the structure;

web stiffeners affixed to the sides of said web comprised of elongated bar-like members each having a minor longitudinal portion thereof offset with respect to the remainder of said bar-like member;

each of said bar-like members being welded to said web on either side of said minor longitudinal portion; and said minor longitudinal portion of each member being free of attachment of said web.

13. A pusher ram head for coke ovens and the like wherein said ram head is affixed to one end portion of an elongated generally horizontally disposed pusher ram girder, said ram head comprising:

a generally upstanding ram head body structure having a ram face plate affixed to the front thereof and dimensioned to substantially span the width and height of said oven;

said ram head body structure comprising a substantially continuous plate-like planar web interconnecting front and rear portions of the structure;

the body structure having a vertically extending body plate co-extensive with the rear side of the ram face plate;

rearwardly extending flanges carried on the vertically disposed side edges of said ram face plate, the flanges being spaced from and positioned to shade adjacent portions of said ram head from radiant heat emanating from the coke and the oven walls; and means securing the ram face plate to the body front plate with said plates in spaced parallel relationship.

14. A pusher ram head as in claim 13 in which said planar web has cut-out portions therein to reduce weight and heat absorption.

15. A pusher ram head as in claim 14 having ring-like heat shield members affixed to said web and flanking both sides of said cut-out portions in spaced, parallel relation thereto.

16. A pusher ram head as in claim 15 in which the peripheral dimensions of said shield members are similar to but greater than those of the respective cut-out portions.

17. A pusher ram head as in claim 16 in which the shield members have openings therethrough that are smaller than the cut out portions of the web.

18. A pusher ram head for coke ovens and the like wherein said ram head is affixed to one end portion of an elongated generally horizontally disposed pusher ram girder, said ram head comprising:

a generally upstanding ram head body structure having means forming a ram face dimensioned to substantially span the width and height of said oven;

said ram head body structure having a substantially continuous plate-like planar web interconnecting its front and rear portions;

web stiffeners affixed to the sides of said web comprised of elongated bar-like members having a minor longitudinal portion thereof offset with respect to the remainder of said bar-like members;

each of said bar-like members being welded to said web on either side of said minor longitudinal portion; and said minor longitudinal portions of each of said bar-like members being free of attachment to said web.

19. A pusher ram head as in claim 18 in which said web stiffeners include at least one such stiffener in which said offset portion is located centrally of its length.

20. A pusher ram head as in claim 18 in which said web stiffeners include at least one such stiffener having offset portions adjacent both ends extending in opposite angular directions.

21. A pusher ram head as in claim 18 in which said web stiffeners include at least one such stiffener having offset portions adjacent both ends extending in the same angular direction.

22. A pusher ram head as in claim 18 in which said web stiffeners include at least a pair of such stiffeners, one of which is end joined to an intermediate portion of the other.

23. A pusher ram head as in claim 22 which includes cut-out portions in said web adjacent said web stiffeners.

24. A pusher ram for coke ovens and the like comprising:

an upstanding ram head having a ram face substantially spanning the width and height of said oven;

a horizontal ram girder affixed to the rear of said ram head and comprised of an elongated upper longitudinal beam member, an elongated lower longitudinal beam member and web means intergrating said upper and lower beam members into a structural ram girder;

the front end of said ram girder adjacent said ram head being comprised of a plurality of parallel arranged, spaced apart bull nose plate members extending transversely of said girder, each said bull nose plate member being bent along its upper and lower ends and effectively tee welded along the edges of said bent ends to said upper and lower beam members respectively; and interplate bracing extending between said spaced apart bull nose plate members tying said bull nose members together.

25. A pusher ram as in claim 24 which further includes bracing extending between the frontmost bull nose plate member and the front of said ram girder.

26. A pusher ram as in claim 24 which further includes a longitudinal web section following said bull nose plate members comprised of structural plates that extend between said upper and lower beam members and are arranged with their major surfaces facing longitudinally and extending transversely of said ram girder; and strut-like bending control means carried on said structural plates at an intermediate location between said upper and lower beam members so as to locally constrain transverse bending movement of said structural plates at such intermediate location while leaving portions above and below unconstrained, when said structural plates are heated and subsequently cooled.

* * * * *